US006809228B2

(12) United States Patent
Ducreux et al.

(10) Patent No.: US 6,809,228 B2
(45) Date of Patent: Oct. 26, 2004

(54) PROCESS COMBINING HYDROISOMERISATION AND SEPARATION USING A ZEOLITIC ADSORBENT WITH A MIXED STRUCTURE FOR THE PRODUCTION OF HIGH OCTANE NUMBER GASOLINES

(75) Inventors: Olivier Ducreux, Bougival (FR); Elsa Jolimaitre, Paris (FR)

(73) Assignee: Institut Francais DuPetrole, Rueil-Malmaison (FR)

( * ) Notice: Subject to any disclaimer, the term of this patent is extended or adjusted under 35 U.S.C. 154(b) by 263 days.

(21) Appl. No.: 09/935,665

(22) Filed: Aug. 24, 2001

(65) Prior Publication Data

US 2002/0043480 A1 Apr. 18, 2002

(30) Foreign Application Priority Data

Aug. 25, 2000 (FR) ..... 00 10

(51) Int. Cl.[7] ..... C07C 5/22; C07C 7/12
(52) U.S. Cl. ..... 585/738; 585/820; 208/134
(58) Field of Search ..... 585/738, 820; 208/134

(56) References Cited

U.S. PATENT DOCUMENTS 2,935,467 A * 5/1960 Fleck et al. ..... 208/310
3,020,322 A * 2/1962 Allen ..... 585/302
3,150,205 A * 9/1964 Krane et al. ..... 585/738
3,160,581 A * 12/1964 Mattox et al. ..... 208/310
3,227,647 A * 1/1966 Krane ..... 208/310
4,783,574 A * 11/1988 Barnes ..... 585/738
4,855,529 A * 8/1989 Stem et al. ..... 585/737
4,982,048 A * 1/1991 Stem et al. ..... 585/751
5,602,291 A * 2/1997 Minkkinen et al. ..... 585/738
5,744,684 A * 4/1998 Zinnen et al. ..... 585/737
6,069,289 A * 5/2000 Dandekar et al. ..... 585/820
6,156,950 A * 12/2000 Ragil et al. ..... 585/802
6,338,791 B1 * 1/2002 Ragil et al. ..... 208/63
6,353,144 B1 * 3/2002 Ragil et al. ..... 585/825
6,436,278 B1 * 8/2002 Benazzi et al. ..... 208/62

FOREIGN PATENT DOCUMENTS

EP 0 922 748 A1 6/1999
EP 0 934 996 A1 8/1999
FR 2 771 419 5/1999

* cited by examiner

*Primary Examiner*—Walter D. Griffin
(74) *Attorney, Agent, or Firm*—Millen, White, Zelano, Branigan, P.C.

(57) ABSTRACT

For producing a gasoline stock with a high octane number, employed are at least one hydroisomerisation section and at least one section for adsorptively separating multibranched paraffins contained in a constituted by a C5 to C8 cut. The separation section contains at least one zeloitic adsorbent with a mixed structure with principal channels with openings defined by a ring containing 10 oxygen atoms and secondary channels with openings by a ring of at least 12 oxygen atoms, the secondary channels only being accessible to the feed to be separated via the principal channels.

38 Claims, 2 Drawing Sheets

FIG.1A
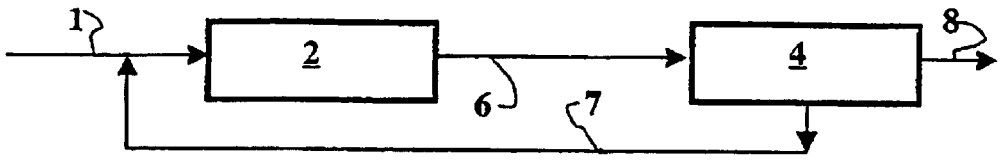
FIG.1B
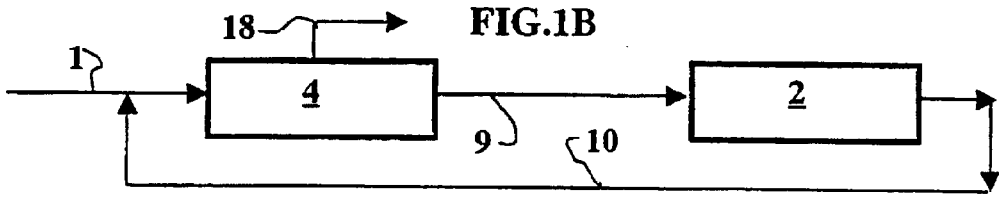
FIG.2.1A
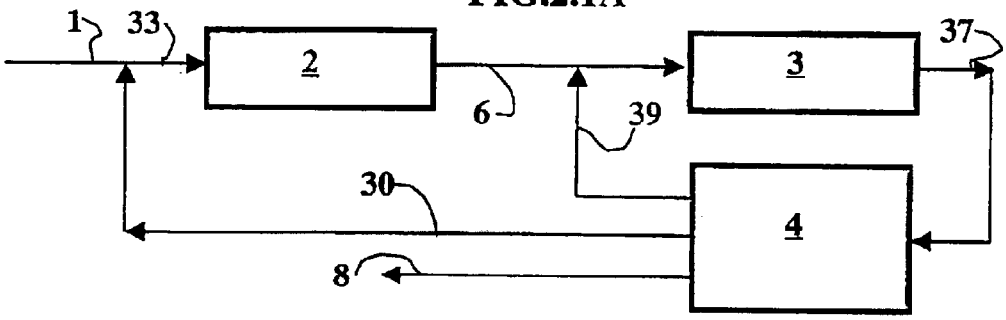
FIG.2.1B
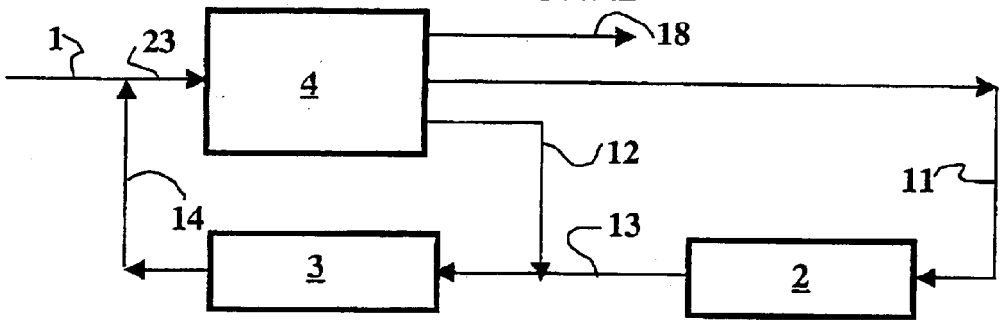
FIG.2.2A
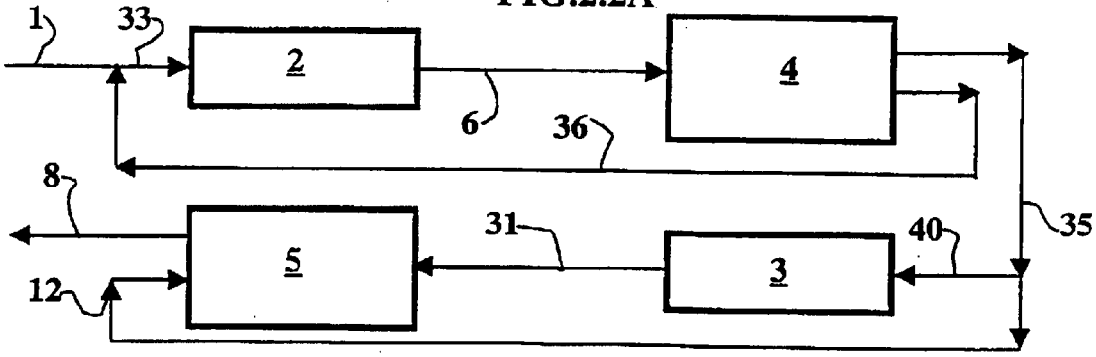

FIG.2.2B
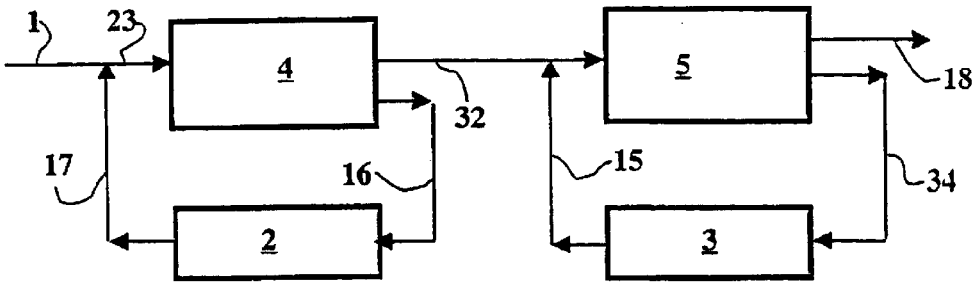
FIG.2.2C
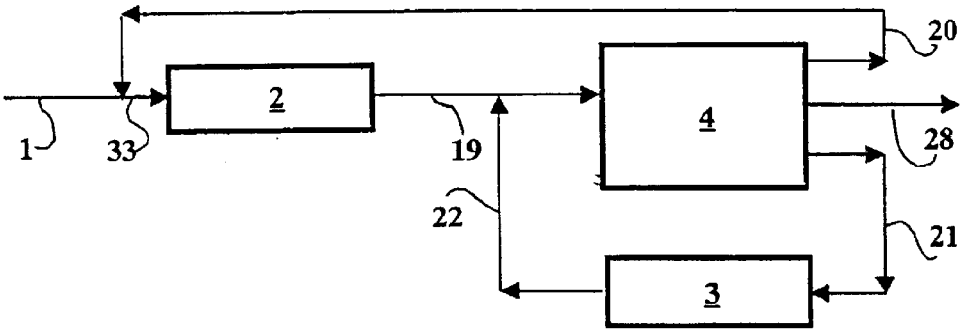
FIG.2.2D
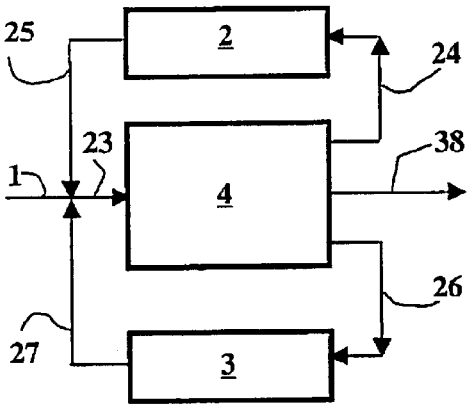
FIG.3
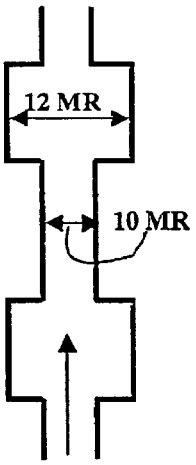
FIG.4
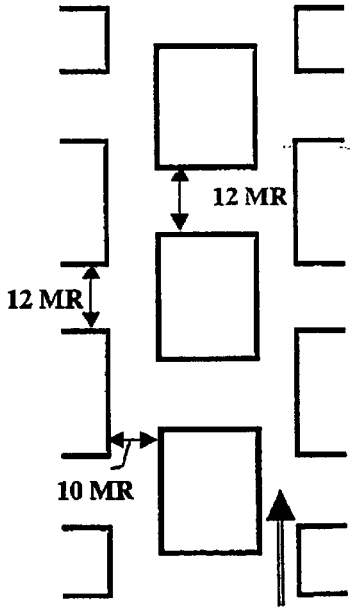

PROCESS COMBINING HYDROISOMERISATION AND SEPARATION USING A ZEOLITIC ADSORBENT WITH A MIXED STRUCTURE FOR THE PRODUCTION OF HIGH OCTANE NUMBER GASOLINES

The present invention relates to the production of high octane number gasoline using a process combining at least one hydroisomerisation section and at least one section for separation by adsorption in which the adsorbent is a microporous solid zeolite with a mixed structure, with channels with distinct sizes.

More precisely, the process of the invention can produce a high octane number gasoline stock that forms part of the composition of the gasoline pool.

The quality of a gasoline is partially dependent on its octane number. From the point of view of the octane number, the hydrocarbons constituting the gasoline are preferably as highly branched as possible as shown by the research octane number (RON) and motor octane number (MON) of different hydrocarbon compounds (see table below).

| Paraffins | nC8 | nC7 | Mono C7 | Mono C6 | Di C6 | Di C5 | Tri C4 | Tri C5 |
|---|---|---|---|---|---|---|---|---|
| RON | <0 | 0 | 21–27 | 42–52 | 55–76 | 80–93 | 112 | 100–109 |
| MON | <0 | 0 | 23–39 | 23–39 | 56–82 | 84–95 | 101 | 96–100 |

A number of techniques have been proposed in order to increase the octane number of a gasoline. Firstly, aromatic compounds, principal constituents of reforming gasolines, and isoparaffins produced by aliphatic alkylation or isomerisation of light gasolines have compensated for the loss of octane number resulting from removing lead from gasolines, this removal being as a result of environmental constraints that are constantly being tightened up. As a result, oxygen-containing compounds such as methyl tertiobutyl ether (MTBE) or ethyl tertiobutyl ether (ETBE) have been introduced into the fuels. More recently, the acknowledged toxicity of compounds such as aromatics, in particular benzene, olefins and sulphur-containing compounds, and the desire to reduce the vapour pressure of gasolines, have resulted in the production of reformulated gasoline. As an example, since Jan. 1, 2000, the maximum olefin content, total aromatics content and benzene content of gasoline distributed in France are respectively 18% by volume, 42% by volume and 1% by volume.

Gasoline pools comprise a number of components. The major components are reforming gasoline, which normally comprises 60% to 80% by volume of aromatic compounds, and FCC gasolines, which typically contain 35% by volume of aromatics but supply the majority of the olefinic and sulphur-containing compounds present in the gasoline pool. The other components can be alkylates, with neither aromatic compounds nor olefins, light isomerised or non isomerised gasolines, which contain no unsaturated compounds, oxygen-containing compounds such as MTBE, and butanes. Provided that the aromatics content is not reduced to below 35–40 vol %, the contribution of reformates to gasoline pools remains high, typically 40 vol %. In contrast, increased tightening of the maximum admissible aromatic compounds content to 20–25 vol % will cause a reduction in the use of reforming, and as a result will need straight run C7–C10 cuts to be upgraded by methods other than reforming.

To this end, the production of multibranched isomers from slightly branched heptanes and octanes contained in naphthas, instead of producing toluene and xylenes from those compounds, appears to be a promising route. This justifies the search for catalysts that perform well for heptane isomerisation (also known as hydroisomerisation when carried out in the presence of hydrogen), octanes and, more generally, C5–C8 cuts and intermediate cuts, and the search for processes that can selectively recycle the low octane number compounds, namely linear and monobranched paraffins to the isomerisation (hydroisomerisation) stage.

In order to selectively recycle the linear and monobranched paraffins to the hydroisomerisation stage and to recover multibranched paraffins with a high octane number, to introduce them into the composition of the gasoline pool, the multibranched paraffins must be separated at least once. A separation unit, producing at least two distinct effluents, one with a high octane number and the other with a low octane number, and integrated into a process also comprising at least one hydroisomerisation unit to recycle the low octane number effluent to the hydroisomerisation unit, which converts linear paraffins and monobranched paraffins with a low octane number to multibranched paraffins with a high octane number.

The main difficulty in carrying out such a process combining hydroisomerisation and separation steps is separating the multibranched paraffins.

PRIOR ART

Techniques for separation by adsorption, using molecular sieves that are selective because of the dimensions of their accessible pores, are particularly suitable for separating linear, monobranched and multibranched paraffins. Conventional adsorption processes can result in procedures of the PSA (pressure swing adsorption), TSA (temperature swing adsorption), chromatographic (elution chromatography or simulated counter-current) type, for example. They can also result in a combination of these procedures. Such processes all bring a liquid or gaseous mixture into contact with a fixed bed of adsorbent to eliminate certain constituents of the mixture that may be adsorbed. Desorption can be carried out by different means. The common characteristic of PSA is that the bed is regenerated by de-pressurisation and in some cases by a low pressure flush. PSA type processes have been described in U.S. Pat. No. 3,430,418 or in the more general work by Yang ("Gas separation by adsorption processes", Butterworth Publishers, US, 1987) In general, PSA type processes are operated sequentially and using all the adsorption beds in alternation. Such PSA processes have been successful in the natural gas field, for separating the compounds in air, for producing solvent and in different refining sectors.

TSA processes use temperature as the desorption driving force and were the first adsorption processes to be developed. The bed to be regenerated is heated by circulating a preheated gas in an open or closed loop in the reverse direction to that of the adsorption step. A number of variations of the schemes ("Gas separation by adsorption processes", Butterworth Publishers, US, 1987) are used depending on local constraints and on the nature of the gas employed. This technique is generally used in purification processes (drying, gas and liquid desulphurisation, natural gas purification: U.S. Pat. No. 4,770,676).

Gas or liquid phase chromatography is a highly effective separation technique because of the very large number of theoretical plates (Belgian patent BE 891 522, Seko M., Miyake J., Inada K.; Ind. Eng. Chem. Prod. Res. Develop., 1979, 18, 263). It means that relatively low adsorption selectivities can be employed and difficult separations can be carried out. The competition from simulated moving bed or simulated counter-current processes for these processes is stiff. These latter processes have been developed to a great extent in the petroleum industry (U.S. Pat. No. 3,636,121, U.S. Pat. No. 3,997,620 and U.S. Pat. No. 6,069,289). The adsorbent is regenerated using the technique for displacement by a desorbent, which can optionally be separated by distillation of the extract and raffinate.

Linear, monobranched and multibranched paraffins can be separated by adsorption by different techniques that are well known to the skilled person: separation by thermodynamic adsorption difference, and separation by differences in the adsorption kinetics of the species to be separated. Depending on the technique used, the selected adsorbent will have different pore diameters. Zeolites, composed of channels, are the adsorbents of choice to separate such paraffins.

The term "pore diameter" is known to the skilled person. It is used as a functional definition of pore size in terms of the size of the molecule that can enter into the pore. It does not define the actual dimension of the pore as that is often difficult to determine, since it often has an irregular shape (i.e., non circular). D. W. Breck provides a discussion on effective pore diameter in the book entitled "*Zeolite molecular sieves* (John Wiley & Sons, New York, 1974) on pages 633 to 641. The cross sections of the zeolite channels are rings of oxygen atoms, so the zeolite pore size can also be defined by the number of oxygen atoms forming the annular cross section of the rings, termed "member rings", MR. This is shown, for example, in "The atlas of zeolite structure types", W. M. Meier and D. H. Olson, $4^{th}$ edition, 1996), which indicates that FAU structure type zeolites have a crystal channel network of 12 MR, i.e., the cross section is constituted by 12 oxygen atoms. This definition is well known to the skilled person and will be used below.

The use of adsorption separation processes to fractionate feeds containing linear, monobranched and multibranched plasmids is well known and many patents make reference thereto. Different adsorbents have been recognised in those patents.

In the case of "thermodynamic" separation, the adsorbent has a pore diameter that is higher than the critical diameter of the molecules to be separated. A number of patents describe the separation of multibranched paraffins from linear and monobranched paraffins by selective thermodynamic adsorption. U.S. Pat. No. 5,107,052 proposes preferably adsorption of multibranched paraffins on SAPO-5, AIPO-5, SSZ-24, MgAPO-5 or MAPSO-5 zeolites. U.S. Pat. No. 3,706,813 proposes the same type of selectivity on barium-exchanged X or Y zeolites. U.S. Pat. No. 6,069,289, on the other hand, proposes the use of zeolites with selectivities that are inversely proportional to the degree of branching of the paraffins, such as beta, X or Y zeolites exchanged with alkali or alkaline earth cations, SAPO-31, MAPO-31 zeolites. All of the zeolites cited above have pore diameters of 12 MR.

In the case of "diffusional" separation, the separating power of the adsorbent is due to the difference in the diffusion kinetics of the molecules to be separated in the zeolite pores. In the case of separation of multibranched paraffins from monobranched and linear paraffins, the fact that the higher the degree of branching, the higher the kinetic diameter of the molecule, and thus the slower the diffusion kinetics, can be exploited. For the adsorbent to have a separating power, the adsorbent must have a pore diameter close to that of the molecules to be separated, which corresponds to zeolites with a pore diameter of 10 MR. Many patents describe the separation of linear, monobranched and multibranched paraffins by diffusional selectivity. U.S. Pat. Nos. 4,717,784, 4,804,802, 4,855,529 and 4,982,048 use adsorbents with channel sizes between 8 and 10 MR, the preferred adsorbent being ferrierite. U.S. Pat. No. 4,982,052 recommends the use of silicalite. U.S. Pat. Nos. 4,956,521, 5,055,633 and 5,055,634 describe the use of zeolites with elliptical cross section pores with dimensions in the range 5.0 to 5.5 Å along the minor axis and about 5.5 to 6.0 Å along the major axis, in particular ZSM-5 and its dealuminated form, or silicalite or with dimensions in the range 4.5 to 5.0 Å, in particular ferrierite, ZSM-23 and XZSM-11.

The zeolitic adsorbents proposed for diffusional separation of multibranched paraffins have a homogeneous channel size structure and are only composed of small channels (8 to 10 MR), which considerably reduces their adsorption capacity. Such materials, which suffer primarily from their low adsorption capacity, cannot produce optimum efficiency of the separation unit. The performance of a process combining both hydroisomerisation and separation by adsorption would, therefore, inevitably be hampered.

SUMMARY OF THE INVENTION

The present invention is based on the novel use of zeolitic adsorbents with a mixed structure, composed of two channel types with distinct sizes, in a section for separating multibranched paraffins comprised in a hydrocarbon feed constituted by a cut in the range C5 to C8 and containing linear, monobranched and multibranched paraffins, said separation section being integrated into a process also comprising at least one hydroisomerisation section. The process of the invention comprises at least one hydroisomerisation section and at least one section for separating multibranched paraffins functioning by adsorption and containing at least one zeolitic adsorbent with a mixed structure with principal channels with an opening defined by a ring of 10 oxygen atoms (also termed 10 MR) and secondary channels with an opening defined by a ring of at least 12 oxygen atoms (12 MR), the channels of at least 12 MR only being accessible to the feed to be separated via the 10 MR channels.

The zeolitic adsorbents of the invention are zeolites that advantageously have structure types EUO, NES and MWW. NU-85 and NU-86 zeolites are also particularly suitable for carrying out the process of the invention.

In a first version of the process of the invention, the process comprises at least one hydroisomerisation section and at least one separation section. The hydroisomerisation section comprises at least one reactor. The separation section (composed of one or more units) produces two fluxes, a first flux that is rich in di- and tri-branched paraffins, possibly in naphthenes and aromatics, which constitutes the high octane number gasoline stock and which is sent to the gasoline pool, and a second flux that is rich in linear and monobranched paraffins that is recycled to the inlet to the hydroisomerisation section.

In a further version of the process of the invention, the overall process comprises at least two hydroisomerisation sections and at least one separation section. The separation section (composed of one or more units) produces three fluxes, a first flux that is rich in di- and tri-branched paraffins and possibly naphthenes and aromatic compounds, which constitutes a high octane number gasoline stock and which is sent to the gasoline pool, a second flux that is rich in linear paraffins that is recycled to the inlet to the first hydroisomerisation section, and a third flux that is rich in monobranched paraffins that is recycled to the inlet to the second section. Two types of implementation of this version of the process are preferred: in the first, all of the effluent from the first hydroisomerisation section traverses the second section; in the second, the effluents from the hydroisomerisation sections are sent to the separation section or sections.

The process of the invention can also produce a high octane number gasoline pool by incorporating into said pool a high octane number gasoline stock from the hydroisomerisation of cuts between C5 and C8, such as C5–C8, C5–C6, C5–C7, C6–C8, C6–C7, C8, etc.

IMPORTANCE OF THE INVENTION

The zeolitic adsorbents used in the separation section for implementing the process of the invention have substantially improved adsorbent properties over prior art adsorbents, in particular as regards the adsorption capacity itself. It has surprisingly been discovered that the use of a zeolitic adsorbent with at least two channel types with distinct sizes, principal channels with an opening defined by a ring of 10 oxygen atoms and secondary channels with an opening defined by a ring with at least 12 oxygen atoms, has a beneficial effect on the performance of a process for separating multibranched paraffins comprised in a hydrocarbon feed constituted by a C5 to C8 cut and containing linear, monobranched and multibranched paraffins in particular. The zeolitic adsorbent used in the separation section of the process of the invention combines good selectivity with optimum adsorption capacity, ensuring productivity gains over prior art adsorbents. This results in better yields for the process of the invention over other processes combining hydroisomerisation and separation by adsorption with prior art adsorbents.

The process of the invention leads to an improvement in the separation process combined with the hydroisomerisation process. Combining these processes upgrades light cuts comprising paraffinic, naphthenic, aromatic and olefinic hydrocarbons containing 5 to 8 carbon atoms, by hydroisomerisation and recycling low octane number paraffins, i.e., linear and monobranched paraffins, while the multibranched paraffins, with a high octane number, separated from the linear and monobranched paraffins, constitute a gasoline stock that is sent to the gasoline pool. Said base can increase the octane number of the gasoline pool.

The process of the invention aims to modify the landscape of gasoline production by reducing the aromatics content while keeping the octane number high, by sending a feed constituted by a C5–C8 cut (for example obtained from straight run distillation) or any intermediate cut between C5 and C8, not only to units for reforming and hydroisomerising C5–C6 paraffins, but to at least one hydroisomerisation section that converts linear paraffins (nCx, x=5 to 8) to branched paraffins and possibly monobranched paraffins ($monoC_{(x-1)}$) to di- and tri-branched paraffins ($diC_{x-2)}$ or $triC_{(x-3)}$).

BRIEF DESCRIPTION OF THE DRAWINGS

FIGS. 1A and 1B illustrate embodiments of the invention having a hydroisomerisation section comprising at least one reactor, and a separation section comprising by at least one unit;

FIGS. 2.1A, 2.1B, 2.2A, 2.2B, 2.2C and 2.2D illustrate embodiments of the invention wherein the hydroisomerisation reation is carried out in at least two distinct sections, each comprising at least one reactor, and in which the feed is fractionated into three fluxes in at least one separation section, comprising at least one unit;

FIG. 3 illustrates a zeolite with structure type EUO having principal channels with 10 MR openings that are provided with side pockets channels of at least 12 MR; and FIG. 4 illustrates a zeolite with structure type NES having an interconnected two-dimensional network wherein 10 MR channels are connected together by a porous 12 MR segments, perpendicular to the 10 MR channels.

DETAILED DESCRIPTION OF THE INVENTION

The process for producing a gasoline stock with a high octane number of the invention uses at least one hydroisomerisation section and at least one separation section functioning by adsorption and containing at least one zeolitic adsorbent. The separation section integrated into the process of the invention is designed to separate multibranched paraffins from linear and monobranched paraffins, contained in a feed constituted by a C5 to C8 cut. Said section for separating multibranched paraffins produces at least two effluents, a first effluent with a high octane number, rich in dibranched and tribranched paraffins and possibly in naphthenes and/or aromatics, and a second effluent with a low octane number that is rich in linear and monobranched paraffins. In accordance with the invention, the linear paraffins and monobranched paraffins are recycled to the hydroisomerisation section to convert them into compounds with a better octane number. In general, the hydroisomerisation section converts linear paraffins into monobranched paraffins and monobranched paraffins into multibranched paraffins.

The term "multibranched paraffins" as used below means paraffins with at least two branches. In accordance with the invention, the term "multibranched paraffins" includes dibranched paraffins.

The process of the invention is characterized in that said adsorbent, in the separation section, has a mixed structure with principal channels with an opening defined by a ring with 10 oxygen atoms (10 MR) and secondary channels with an opening defined by a ring with at least 12 oxygen atoms (12 MR), the channels with at least 12 MR only being accessible via the 10 MR channels. Note that the 10 MR channels or 12 MR channels can be diagrammatically represented by a continuous succession of rings, each ring being constituted by 10 or 12 oxygen atoms. The invention is not limited to the use of a zeolitic adsorbent with channels with a specific number of rings. In particular, the invention also encompasses separating multibranched paraffins with an adsorbent with 10 MR channels restricted to a single ring. These zeolitic adsorbents can have a one-, two- or three-dimensional structure.

In accordance with the invention, the zeolitic adsorbent preferably adsorbs linear paraffins, monobranched paraffins to a lesser extent and finally, minor amounts of multibranched paraffins, naphthene compounds and aromatics.

Within the context of reducing the aromatic content of the gasolines, the feed treated in the process of the invention is constituted by a cut between C5 and C8, such as C5–C8, C5–C6, C5–C7, C6–C8, C6–C7, C7–C8, C7, C8, etc., from atmospheric distillation of a crude, from a reforming unit (light reformate) or from a conversion unit (naphthene hydrocracking, for example). The remainder of the text will refer to this set of possible feeds as "C5–C8 cuts and intermediate cuts". It is principally composed of linear, monobranched and multibranched paraffins, naphthenic compounds such as dimethylcyclopentanes, aromatic compounds such as benzene or toluene, and possibly olefinic compounds.

The feed introduced into the process of the invention comprises at least one alkane that will be isomerised to form at least one product with a higher degree of branching. The feed can contain normal pentane, 2-methylbutane, neopentane, normal hexane, 2-methylpentane, 3-methylpentane, 2,2-dimethylbutane, 2,3-dimethylbutane, normal heptane, 2-methylhextane, 3-methylhexane, 2,2-dimethylpentane, 3,3-dimethylpentane, 2,3-dimethylpentane, 2,4-dimethylpentane, 2,2,3-trimethylbutane, normal octane, 2-methylheptane, 3-methylheptane, 4-methylheptane, 2,2-dimethylhexane, 3,3-dimethylhexane, 2,3-dimethylhexane, 3,4-dimethylhexane, 2,4-dimethylhexane, 2,5-dimethylhexane, 2,2,3-trimethylpentane, 2,3,3-trimethylpentane, or 2,3,4-trimethylpentane If the feed originates from C5–C8 feeds and/or intermediate cuts obtained after atmospheric distillation, it can also contain cyclic alkanes, such as dimethylcyclopentanes, aromatic hydrocarbons (such as benzene, toluene, xylenes) and other C9+hydrocarbons (i.e., hydrocarbons containing at least 9 carbon atoms) in smaller quantities. Feeds constituted by C5–C8 cuts and intermediate cuts of reformate origin can also contain olefinic hydrocarbons, in particular when the reforming units are operated at low pressure.

The paraffin content (P) essentially depends on the origin of the feed, i.e., its paraffinic or naphthenic or aromatic nature, occasionally measured by the parameter N+A (sum of the naphthene content (N) and the aromatics content (A)), and its initial boiling point, i.e., the amount of C5 and C6 in the feed. In hydrocracking naphthas, rich in naphthenic compounds, or light reformates, rich in aromatic compounds, the amount of paraffins in the feed is generally low, of the order of 30% by weight. In straight run C5–C8 cuts and intermediate cuts (such as C5–C8, C5–C6C5–C7, C6–C8, C6–C7, C7–C8, . . . ), the paraffin content varies between 30% and 80% by weight, with a mean value of 55–60% by weight. In accordance with the invention, the octane gain is higher when the paraffin content in the feed is higher.

In the case of a C5–C8 feed or a feed composed of intermediate cuts from atmospheric distillation, obtained at the head of the naphtha splitter, for example, the heavy fraction corresponding to the naphtha can supply a catalytic reforming section. In that case, installing a hydroisomerisation section for those cuts will cause a reduction in the feed flow to the reforming section, which could continue to treat the heavy C8+ fraction of the naphtha.

The effluent from the hydroisomerisation section can contain the same types of hydrocarbons as those described above, but their respective proportions in the mixture leads to RON and MON octane numbers that are higher than those in the feed.

The feed introduced in the process of the invention and containing paraffins containing 5 to 8 carbon atoms generally has a low octane number. The process of the invention consists of increasing the octane number of said feed without reducing its aromatics content by using a hydroisomerisation section and at least one separation section functioning by adsorption.

The octane number of the effluent from the process of the invention varies as a function of the nature of the feed introduced, in particular as a function of the nature of the cut. For a C5–C6 cut from crude petroleum distillation, typical RON and MON values for the gasoline stock at the outlet from the process of the invention are respectively of the order of 93 and 89. A gasoline stock comprising such a gasoline stock in its composition will thus have a high octane number.

In accordance with the invention, the separation section contains one or more adsorbents, at least one of the adsorbents being a zeolitic solid with a mixed structure the microporous network of which has both principal channels with an opening defined by a ring of 10 oxygen atoms (10 MR) and secondary channels the opening of which is defined by a ring with at least 12 oxygen atoms (12 MR), said principal and secondary channels being disposed such that access to the secondary channels of at least 12 MR is only possible via the principal 10 MR channels.

These different adsorbents have channel sizes such that each of the isomers in the C5–C8 cuts or intermediate cuts can be adsorbed. The diffusion kinetics of these isomers in the 10 MR channels is sufficiently different, however, to be exploited.

In accordance with the invention, optimum diffusion selectivity is obtained by stopping the multibranched molecules from entering via the 10 MR channels and with an optimum adsorption capacity that is obtained by the presence of channels of at least 12 MR.

Clearly, the separation section integrated into the process of the invention is based on the difference in adsorption kinetics of the species to be separated and thus exploits the characteristics of "diffusional" separation.

Channels of at least 12 MR can either be simple side pockets (see FIG. 3) or they can form porous segments perpendicular to the 10 MR channels, such that those segments are only accessible via the 10 MR channels (see FIG. 4).

The adsorbents used in the separation section to carry out the process of the invention advantageously contain silicon and at least one element T selected from the group formed by aluminium, iron, gallium and boron, preferably aluminium and boron. The silica content in these adsorbents can vary. Adsorbents that are the most suitable for this type of separation are those with high silica contents. The Si/T mole ratio is preferably at least 10.

Said microporous adsorbents can be in the acidic form, i.e., containing hydrogen atoms, or preferably they are exchanged with alkali or alkaline-earth cations.

It is advantageous to mix the zeolitic adsorbents with zeolites with structure type LTA, as described in U.S. Pat. No. 2,882,243, preferably A zeolite. In the majority of their cation exchanged forms, in particular the calcium form, these zeolites have a pore diameter of the order of 5 Å, and have high linear paraffin adsorption capacities. Mixed with zeolitic adsorbents with a structure as defined above, they can accentuate separation of the elution fronts and resulting in better purity for each of the enriched fluxes obtained.

Advantageously, the zeolitic adsorbents used in the process of the invention are zeolites with structure type EUO, NES and MWW. Examples of zeolites included in this family are EU-1 zeolites (European patent EP-A-0 042 226, ZSM-50 (U.S. Pat. No. 4,640,829), TPZ-3 (U.S. Pat. No. 4,695,667), NU-87 (EP-A-0 378 916), SSZ-37 (U.S. Pat. No. 5,254,514), MCM-22, ERB-1 (EP-A-0 293 032), ITQ-1 (U.S. Pat. No. ? 004,941), PSH-3 (U.S. Pat. No. 4,439,409), and SSZ-25 (EP-A-0 231 860). NU-85 zeolites (U.S. Pat. No. 5,385,718 and EP-A-0 462 745) and NU-86 zeolites (EP-A-0 463 768), the structure type of which have not been determined are also advantageously used in the process of the invention.

Zeolites with structure type EUO (EU-1, ZSM-50, TPZ-50) have a one-dimensional pore network. The principal channels have 10 MR openings and they are provided with side pockets corresponding to an opening of 12 MR. The configuration of these zeolites with structure type EUO is shown in FIG. 3.

Zeolites with structure type NES (NU-87 and SSZ-37) have an interconnected two-dimensional network. In one direction are the 10 MR channels, connected together by porous 12 MR segments, perpendicular to the 10 MR channels. The 12 MR channels are thus only accessible via the 10 MR channels. The configuration of these zeolites with structure type NES is that shown in FIG. 4.

It should be stated that NU-85 is a hybrid of NU-87 and EU-1 zeolites: each NU-85 crystal comprises discrete bands of NU-87 and EU-1, said bands enjoying continuity of the crystalline network between them.

NU-86 zeolite has a three-dimensional pore network. In one of its dimensions are channels containing 11 oxygen atoms (11 MR). In the other two dimensions are channels with 12 oxygen atoms with 10 MR restrictions. The 12 MR channels are only accessible via the 10 MR channels. The configuration of the NU-86 zeolite is that shown in FIG. 3.

Zeolites with structure type MWW (MCM-22, ERB-1, ITQ-1, PSH-3, SSZ-25) have a non-interconnected two-dimensional network. One of the pore networks is constituted by 10 MR channels, and the second is constituted by 12 MR channels connected together via 10 MR channels, such that access to the 12 MR channels is only via 10 MR channels. The configuration of these zeolites with structure type MWW is shown in FIG. 3.

Any other zeolitic adsorbent with principal channels with the opening defined by a ring of 10 oxygen atoms and secondary channels with an opening defined by a ring with more than 12 oxygen atoms, the secondary channels being accessible to the feed to be separated only via the principal channels, is suitable for carrying out the process of the invention.

A number of versions and implementations of the process are possible, depending on the number and arrangement of the different hydroisomerisation or separation sections and the different recycles.

For all of the versions and implementations of the process of the invention, the adsorption separation sections using one or more adsorbents separate multibranched paraffins from normal and monobranched paraffins, the normal and monobranched paraffins then being recycled. In variations of the process, the separation section can be disposed upstream or downstream of the hydroisomerisation section. The separation section integrated into the process of the present invention can employ adsorption separation techniques that are well known to the skilled person, such as PSA (pressure swing adsorption), TSA (temperature swing adsorption) and chromatographic processes (elution chromatography or simulated counter-current, for example) or a combination of those techniques. The separation section can also function in the liquid phase or in the gas phase. Further, in general, a plurality of separation units (two to fifteen) are used in parallel and in alternation to produce a section operating continuously although it is discontinuous by nature.

The operating conditions for the separation section depend on the adsorbent or adsorbents under consideration, and on the desired degree of purity of each of the fluxes. The conditions are a temperature in the range 50° C. to 450° C., and a pressure of 0.01 to 7 MPa. More precisely, if separation is carried out in the liquid phase, the separation conditions are: a temperature of 50° C. to 250° C. and a pressure of 0.1 to 7 MPa, preferably 0.5 to 5 MPa. If said separation is carried out in the gas phase, the conditions are: a temperature of 150° C. to 450° C., and a pressure of 0.01 to 7 MPa, preferably 0.1 to 5 MPa.

In a first preferred version of the process (FIGS. 1A and 1B for variations 1*a* and 1*b*), the hydroisomerisation section 2 comprises at least one reactor. Separation section 4, functioning by adsorption, constituted by at least one unit, produces two fluxes, a first flux with a high octane number, rich in dibranched and tribranched paraffins, possibly in naphthenes and aromatics (flux 8 for variation 1*a* and 18 for variation 1*b*), which constitutes a high octane number gasoline stock and can be sent to the gasoline pool, a second flux rich in linear paraffins and monobranched paraffins, which is recycled (7 for variation 1*a* and 9 for variation 1*b*) to the inlet to hydroisomerisation section 2. The term "recycled" means both initial introduction and re-introduction into the hydroisomerisation section of linear and monobranched paraffins, as explained below depending on whether the separation section is disposed upstream or downstream of the hydroisomerisation section. In variation 1*a,* hydroisomerisation section 2 precedes separation section 4 while the opposite is true for variation 1*b*. As a result, in variation 1*a,* only linear and monobranched paraffins are recycled to the hydroisomerisation section (flux 7). In variation 1*b,* all of effluent 10 from hydroisomerisation section 2 is recycled to separation section 4. Said effluent thus contains linear, monobranched and multibranched paraffins. The operating conditions for this variation of the process are particularly selected to minimise cracking of dibranched and tribranched paraffins containing more than 7 carbon atoms. Further, in the case where the process feed includes a C5 cut, the process for recycling linear and monobranched paraffins can optionally comprise a deisopentaniser, disposed upstream or downstream of the hydroisomerisation and/or separation sections. In particular, it can be placed in feed 1, between the separation and hydroisomerisation sections (flux 6 and 9) or on recycled fluxes 7 and 10. Preferably, isopentane can be eliminated insofar as it is not isomerised to a higher degree of branching under the operating conditions of the hydroisomerisation section.

It may be of advantage to add a depentaniser or a combination of a depentaniser and a deisopentaniser to at least one of fluxes 1, 6, 9, 7 or 10. Isopentane, pentane or a mixture of these two withdrawn from the feed can advantageously act as the eluent for the separation section. Isopentane can also optionally be sent directly to the gasoline pool because of its high octane number.

Similarly, when the cut contains no C5 but contains C6, a deisohexaniser can optionally be placed on at least one of fluxes 1, 6, 7, 9 or 10 (FIGS. 1A and 1B). The isohexane recovered can act as an eluent for the adsorption separation section. Preferably, isohexane is not sent to the gasoline pool because its octane number is too low and as a result, it must be separated from high octane number fluxes 8 or 18.

In general, it may be advantageous to prepare one or more light fractions by distillation of the feed, which can act as an eluent for the separation section. This use of a portion of the feed in the separation section constitutes very good integration of said separation section. However, this section can also use other compounds. In particular, light paraffins such as butane and isobutane can advantageously be used, as they are readily separable from heavier paraffins by distillation.

Finally, when the separation section is disposed upstream of the hydroisomerisation section (variation 1*b*), the quantity of naphthenic and aromatic compounds traversing the hydroisomerisation section is lower than in the opposite configuration (variation 1*a*). This limits saturation of the aromatic compounds contained in the C5 to C8 cuts resulting in a lower hydrogen consumption in the hydroisomerisation section. Further, in variation 1*b,* the volumes of fluxes traversing the hydroisomerisation section are reduced with respect to variation 1*a,* which allows a reduction in the size of this section, and minimises the quantity of catalyst required.

In a second, preferred, version of the process (FIGS. 2.1A, 2.1B, 2.2A, 2.2B, 2.2C, 2.2D, embodiments 2.1 and 2.2; variations 2.1*a* and *b;* 2.2*a, b, c* and *d*), the hydroisomerisation reaction is carried out in at least two distinct sections, each comprising at least one reactor (sections 2 and 3). The feed is fractionated into three fluxes in at least one separation section functioning by adsorption (sections 4 and optionally 5), comprising at least one unit, to result in the production of a first flux that is rich in dibranched and tribranched paraffins, possibly in naphthenes and aromatics, a second flux that is rich in linear paraffins and a third flux that is rich in monobranched paraffins. The effluent that is rich in linear paraffins is recycled to the hydroisomerisation section 2 and the effluent that is rich in monobranched paraffins is recycled to hydroisomerisation section 3.

In a first embodiment (2.1) of the second version of the process, all of the effluent leaving the first hydroisomerisation section is sent to the second hydroisomerisation section 3. This embodiment comprises two variations in which the separation section, composed of one or possibly more units, is located downstream (variation 2.1*a*) or upstream (variation 2.1*b*) of the hydroisomerisation section.

In variation 2.1*a* (FIG. 2.1A), fresh feed (flux 1) containing linear, monobranched and multibranched paraffins, also naphthenic and aromatic compounds, is mixed with the linear paraffin recycle from separation section 4 (flux 10). The resulting mixture 33 is sent to the first hydroisomerisation section 2 that converts a portion of the linear paraffins to monobranched paraffins and a portion of the monobranched paraffins to multibranched paraffins. The effluent (flux 6) leaving the hydroisomerisation section 2 is mixed with recycle 39, which is rich in monobranched paraffins and comes from separation section 4, then the mixture is sent to hydroisomerisation section 3. Effluent 37 from section 3 is sent to separation section 4. This section 4 produces three fluxes by separation to produce three effluents that are rich either in linear paraffins (30), or in monobranched paraffins (39), or in multibranched paraffins, naphthenic compounds and aromatic compounds (8). The effluent (8) that is rich in multibranched paraffins and in naphthenic and aromatic compounds has a high octane number, and constitutes a gasoline stock with a high octane number and can be sent to the gasoline pool. The process of the invention leads to the production of a gasoline that is rich in multibranched paraffins with a high octane number.

In a variation 2.1*b* (FIG. 2.1B), fresh feed (flux 1) containing linear, monobranched and multibranched paraffins, and naphthenic and aromatic compounds, is mixed with flux 14 from hydroisomerisation section 3, then the resulting mixture 23 is sent to separation section 4 in which the feed is fractionated into three fluxes leading to the production of three effluents rich either in linear paraffins (11), or in monobranched paraffins (12) or in multibranched paraffins, naphthenic compounds and aromatic compounds (18). Effluent (11) that is rich in linear paraffins is sent to hydroisomerisation section 2. Effluent (18) that is rich in multibranched paraffins and in naphthenic and aromatic compounds has a high octane number. Said effluent (18) thus constitutes a high octane number gasoline stock and can be sent to the gasoline pool. Hydroisomerisation section 2 converts a portion of the linear paraffins into monobranched paraffins and multibranched paraffins. The flux rich in monobranched paraffins (12) from separation section 4 is added to the effluent (13) from section 2. The ensemble is sent to the second hydroisomerisation section 3 (FIG. 2.1B).

The configurations of variations 2.1*a* and 2.1*b* have many advantages. These configurations can cause the two hydroisomerisation sections 2 and 3 to be operated at different temperatures and different HSVs to minimise cracking of the dibranched and tribranched paraffins, which is of particular importance for the cuts under consideration. They can also minimise the quantity of catalyst in section 2 by only recycling linear paraffins to that section, which means that a higher operating temperature can be used. On the other hand, section 3, primarily supplied with monobranched paraffins, operates at a lower temperature, improving the yield of dibranched and tribranched paraffins because of the more favourable equilibrium under these conditions, while limiting cracking of multibranched paraffins, discouraged at low temperatures.

When the separation section, composed of one or more units, is disposed upstream of the hydroisomerisation section (variation 2.1*b*), the quantity of naphthenic and aromatic compounds traversing the hydroisomerisation section is lower than in the reverse configuration (variation 2.1*a*). This limits saturation of the aromatic compounds contained in the C5–C8 cut or in intermediate cuts, resulting in a lower hydrogen consumption in the process.

In the case where the feed comprises a C5 cut, in its embodiment 2.1 (variations 2.1*a* and 2.1*b*) the process of the invention can optionally comprise a deisopentaniser, disposed upstream or downstream of the hydroisomerisation and/or separation section. In particular, this deisopentaniser can be placed on flux 1 (feed), between the two hydroisomerisation sections (flux 6 for variation 2.1*a* and flux 13 for variation 2.1*b*), after the hydroisomerisation section (flux 37 or 14), or after the separation section on the monobranched paraffin-rich flux (flux 39 or 12). Preferably, isopentane is optionally eliminated in that it is not isomerised to a higher degree of branching under the operating conditions of the hydroisomerisation section. The isopentane can optionally act as an eluent for the separation section. It can also be sent directly to the gasoline pool because of its high octane number. It may be advantageous to place a depentaniser on at least one of fluxes 1, 6, 37 or 30 (FIG. 2.1A) or 1, 11, 13, 14 (FIG. 2.1B). The combination of a deisopentaniser and a depentaniser is also possible. The separated pentane or mixture of pentane and isopentane can optionally act as an eluent for the adsorption separation section. In the latter case, the pentane is not sent to the gasoline pool because its octane number is too low. As a result, it must be separated from high octane number fluxes 8 or 18.

In the same manner, when the cut contains no C5 but contains C6, a deisohexaniser can optionally be placed on at least one of fluxes 1, 6, 37 or 39 for variation 2.1*a* (FIG. 2.1A) or 1, 13, 14 and 12 for variation 2.1*b* (FIG. 2.1B). The recovered isohexane can act as an eluent for the adsorption separation section. However, isohexane cannot be sent to the gasoline pool because its octane number is too low. As a result, it must be separated from high octane number fluxes 8 or 18 (FIGS. 2.1A and 2.1B).

In general, it may be advantageous to prepare one or more light fractions by distillation of the feed, which can act as an eluent for the separation section.

These uses of a portion of the feed in the separation section constitute very good integration of said separation section. However, this section can also use other compounds. In particular, light paraffins such as butane and isobutane are advantageous as they can readily be separated from heavier paraffins by distillation.

A second embodiment (2.2) of version 2 of the process of the invention is such that the effluents from hydroisomerisation sections 2 and 3 are sent to separation section or sections 4 and 5. This embodiment can be divided into four variations 2.2*a,* 2.2*b,* 2.2*c* and 2.2*d.* Variations 2.2*a* and 2.2*b* (FIGS. 2.2A and 2.2B) correspond to the case where the process comprises at least two separation sections to carry out two different types of separation, i.e., separating linear paraffins and monobranched paraffins in two distinct sections. In variations 2.2*c* and 2.2*c* (FIGS. 2.2C and 2.2D), the separation section can be constituted by one or more units. Variations 2.2*a,* 2.2*b,* 2.2*c* and 2.2*d* represent optimisation of the ensemble of separation and hydroisomerisation sections as they can avoid mixing the high octane number fluxes with the low octane number feed.

Variation 2.2*a* comprises the following steps:

Fresh feed (flux 1, FIG. 2.2A) containing linear, monobranched and multibranched paraffins, naphthenes and aromatic compounds, is mixed with effluent (36) that is rich in linear paraffins from separation section 4, then the resulting mixture 33 is sent to hydroisomerisation section 2 that converts a portion of the linear paraffins into monobranched paraffins and a portion of the monobranched paraffins into multibranched paraffins. The ensemble leaving hydroisomerisation section 2 is sent to separation section 4. Said separation section 4 produces two effluents, respectively rich in linear paraffins (36) and in monobranched and multibranched paraffins, and naphthenic and aromatic compounds (35). Effluent (35) is mixed with the flux (12) that is rich in monobranched paraffins from separation section 5, then sent to hydroisomerisation section 3. Hydroisomerisation section 3 converts a portion of the monobranched paraffins to multibranched paraffins. The ensemble (flux 31) leaving hydroisomerisation section 3 is sent to separation section 5. Said section brings about separation into two fluxes to produce two effluents, one rich in monobranched paraffins (12), the other rich in multibranched paraffins (8). Effluent (8) (FIG. 2.2A), rich in dibranched and tribranched paraffins and in naphthenic and aromatic compounds, has a high octane number; it constitutes a high octane number gasoline stock and can be sent to the gasoline pool.

Variation 2.2*b* differs from variation 2.2*a* in that separation sections 4 and 5 (FIG. 2.2B) are placed upstream of hydroisomerisation sections 2 and 3. In this configuration, feed 1 is mixed with effluent (17) from hydroisomerisation section 2, then the resulting mixture (23) is sent to separation section 4. Said section produces two fluxes, respectively rich in linear paraffins (16) and in monobranched and multibranched paraffins (32).

Flux (16) is sent to hydroisomerisation section 2 to produce effluent (17). Effluent (32) is mixed with flux (15) from hydroisomerisation section 3, then the mixture is sent to separation section 5. Said section produced two effluents, one rich in monobranched paraffins (34), which is sent to the hydroisomerisation section 3, the other rich in multibranched paraffins, naphthenic compounds and aromatic compounds (18), which has a high octane number and constitutes a high octane number gasoline stock. Effluent (18) can thus be sent to the gasoline pool.

In variation 2.2*c* (FIG. 2.2C), the separation section 4 is constituted by one or more units, and is located between two hydroisomerisation sections (2 and 3). In this configuration, feed 1 is mixed with the linear paraffin-rich effluent from separation section 4, and the resulting mixture 33 is sent to hydroisomerisation section 2. This produces an effluent (19) with an octane number that is higher than that of the feed. This effluent (9) is mixed with effluent (22) from the hydroisomerisation section 3, then the ensemble is sent to separation section 4. This section produces three fluxes (20, 21 and 28). Flux (21), which is rich in monobranched paraffins, is sent to hydroisomerisation section 3 which converts these paraffins into more highly branched paraffins. Flux (28), which is rich in multibranched paraffins, naphthenic and aromatic compounds, has a high octane number and constitutes a gasoline stock with a high octane number. The effluent (28, FIG. 2.2C) can thus be sent to the gasoline pool.

In variation 2.2*d* (FIG. 2.2D), the separation section constituted by one or more units is located upstream of the two hydroisomerisation sections. In this configuration, feed 1 is mixed with recycled fluxes (25) and (27) from hydroisomerisation sections 2 and 3 respectively. The resulting flux is sent to separation section 4. This produces three effluents (24), (26) and (38). Flux (24), which is rich in linear paraffins, is sent to hydroisomerisation section 2, which converts these paraffins into more highly branched paraffins. Flux (26), which is rich in monobranched paraffins, is sent to hydroisomerisation section 3 which also converts these paraffins into more highly branched paraffins. Flux (38), which is rich in multibranched paraffins, naphthenic and aromatic compounds, has a high octane number and constitutes a gasoline stock with a high octane number. Effluent (38, FIG. 2.2D) can thus be sent to the gasoline pool.

The configurations of embodiment 2.2 have many advantages. For the embodiment of 2.1, these configurations can cause the two hydroisomerisation sections to be operated at different temperatures and different HSVs to minimise cracking of the dibranched and tribranched paraffins. It can also minimise the quantity of catalyst by only recycling linear paraffins to hydroisomerisation section 2, which means that a higher operating temperature can be used, and that the quantity of catalyst in that section can be minimised. Hydroisomerisation section 3, mainly supplied with monobranched paraffins for 2.2*b, c* and *d* and with monobranched and multibranched paraffins for 2.2*a,* operates at a lower temperature, improving the yield of dibranched and tribranched paraffins because of the more favourable equilibrium under these conditions, while limiting cracking of multibranched paraffins, discouraged at low temperatures. This configuration (with the exception of variation 2.2*d*) can also avoid mixing high octane number fluxes with low octane number fluxes. The recycle fluxes (36, FIG. 2.2A) and (20, FIG. 2.2C) that are rich in linear paraffins are mixed with feed 1. Flux 12, which is rich in monobranched paraffins, is mixed with flux (35) that is rich in monobranched and multibranched paraffins. Finally, fluxes (15) and (22) from hydroisomerisation sections 3 are respectively mixed with fluxes (32) and (19) with an octane number that is higher than that of the feed.

In variations 2.2*b* and 2.2*d* (FIGS. 2.2B and 2.2D), the disposition of separation sections 4 and optionally 5 with respect to hydroisomerisation sections 2 and 3 is such that that the quantity of naphthenic and aromatic compounds traversing the hydroisomerisation section is less than in configuration 2.2*a.* This limits saturation of the aromatic compounds contained in the C5–C8 cut or in intermediate cuts, resulting in a reduced hydrogen consumption in the process. Similarly, in variation 2.2*c,* the disposition of the separation section 4 with respect to the hydroisomerisation section 3 can reduce the hydrogen consumption in the latter.

As with the embodiment of 2.1, when the feed comprises a C5 cut, the process of embodiment 2.2 can optionally comprise a deisopentaniser located upstream or downstream of the separation and hydroisomerisation sections. In particular, this deisopentaniser can be placed on feed flux 1, on any one of fluxes 1, 6, 35, 40, 31, 12 (FIG. 2.2A), on any one of fluxes 1, 32, 34, 15, 17 (FIG. 2.2B), on any one of fluxes 19, 21, 22 (FIG. 2.2C) and on any one of fluxes 23, 25, 26 and 27 (FIG. 2.2D). It may also possibly be of advantage to place a depentaniser on any one of fluxes 1, 6 and 36 (variation 2.2*a*) or 1, 16 and 17 (variation 2.2*b*), 1, 19 and 20 (variation 2.2*c*) or 1,23, 24, 25 (variation 2.2*d*). The combination of a deisopentaniser and a depentaniser is also possible. The separated isopentane, pentane or a mixture of pentane and isopentane can optionally act as an eluent for the adsorption separation section. In the latter case, the pentane is preferably not sent to the gasoline pool because of its low octane number. As a result, it is preferably separated from high octane number fluxes 8, 18, 28 and 38 (FIG. 2.1A and 2.1B). In contrast, isopentane is preferably sent to the gasoline pool with fluxes 8, 18, 28 and 38 because of its good octane number.

Regarding implementation 2.1, when the cut does not contain C5 but contains C6, a deisohexaniser can optionally be placed on any one of fluxes 1, 6, 35, 40, 31 and 12 (FIG. 2.2A) or 1, 32, 34, 15 and 17 (FIG. 2.2B), or 19, 21, 22 (FIG. 2.2C) or 23, 25, 26 and 27 (FIG. 2.2D) The isohexane recovered can act as an eluent for the adsorption separation section. Preferably, the isohexane is not sent to the gasoline pool because of its low octane number. It is preferably separated from high octane number fluxes 8, 18, 28 and 38 (FIGS. 2,2A, 2,2B, 2,2C, 2.2D). This use of a portion of the feed in the separation section constitutes good integration of the process. However, this section can also use other compounds as an eluent for the adsorption separations. In particular, light paraffins such as butane and isobutane are of interest as they are readily separated from heavier paraffins by distillation.

It should be remembered that each separation section integrated into the process of the invention can be composed of several units at least one of which contains a zeolitic adsorbent with the characteristics defined above, namely at least the presence of at least two types of channels, principal channels with an opening defined by a ring with 10 oxygen atoms (10 MR) and secondary channels the opening of which is defined by a ring with at least 12 oxygen atoms (at least 12 MR), said secondary channels only being accessible to the feed to be separated via said principal channels. When said separation section is composed of a plurality of units and at least one of these units contain a zeolitic adsorbent with the characteristics defined above, the other unit or units may contain an adsorbent that is other than the silicalite. It is also allowable to mix a zeolitic adsorbent with the characteristics defined above with a further adsorbent such as those used in the prior art, in the same unit.

For each of the variations of these implementations, light cuts can be hydroisomerised in the gas, liquid or mixed liquid-gas mixture in one or more reactors where the catalyst is used in a fixed bed. As an example, a catalyst can be used that is from the family of bifunctional catalysts, such as catalysts based on platinum or based on a sulphide phase on an acid support (chlorinated alumina, zeolite such as mordenite, SAPO, Y zeolite, beta zeolite) or from the family of monofunctional acid catalysts, such as chlorinated aluminas, sulphated zirconias with or without platinum and promoter, heteropolyacids based on phosphorus and tungsten, molybdenum oxycarbides and oxynitrides that are normally classified as monofunctional catalysts with a metallic nature. They function in a temperature range between 25° C. for the most acidic (heteropolyanions, supported acids) and 450° C., for bifunctional catalysts or molybdenum oxycarbides. Chlorinated aluminas are preferably used between 80° C. and 110° C. and the platinum based catalysts on a zeolite-containing support are preferably used between 260° C. and 350° C. The operating pressure is in the range 0.01 to 0.7 MPa, and depends on the concentration of C5–C6 in the feed, on the operating temperature and on the $H_2$/HC mole ratio. The space velocity, measured in kg of feed per kg of catalyst per hour, is in the range 0.5 to 2. The $H_2$/hydrocarbon mole ratio is generally in the range 0.01 to 50, depending on type of catalyst used and its resistance to coking at the operating temperatures. In the case of low $H_2$/HC ratios, for example $H_2$/HC=0.06, it is not necessary to provide a hydrogen recycle, which saves using a separator drum and a hydrogen recycle compressor.

The hydroisomerisation section can comprise one or more reactors disposed in series or in parallel which can, for example, contain one or more of the catalysts mentioned above. As an example, in the case of variations 1*a* and 1*b*, the hydroisomerisation section 2 comprises at least one reactor, but can comprise two or more reactors disposed in series or in parallel. In the case of variations 2.1*a* and *b*, 2.2*a*, *b*, *c* and *d*, the hydroisomerisation sections 2 and 3 can optionally each comprise two reactors optionally containing two different catalysts. Sections 2 and 3 can also optionally each comprise a plurality of reactors in series and/or in parallel, with different catalysts depending on the reactor.

Similarly, each separation section can be constituted by one or more units that can carry out global separation into two or three effluents that are rich in linear, monobranched and multibranched paraffins, naphthenic and aromatic compounds. Each of separations 4 and/or 5 of any of variations 2.1*a* or *b*, 2.2*a*, *b*, *c* or *d*, comprises at least one separation unit that can be substituted by two or more separation units disposed in series or in parallel.

The process of the invention leads to the production of a gasoline pool with a high octane number due to its incorporation into the composition of a gasoline stock with a high octane number obtained using the process of the invention.

Downstream of the hydroisomerisation section, it is generally advantageous to provide a feed stabilisation column to limit the vapour tension of the isomerate to an acceptable value. This control of the vapour tension can be obtained by eliminating a certain quantity of volatile compounds such as C1 . C4, using techniques that are well known in the art. In the absence of hydrogen recycling, the hydrogen can be separated from the feed in the stabilisation column. When proper functioning of one of the isomerisation catalysts used upstream requires the addition of a chlorinated agent to the feed upstream of the hydroisomerisation section, the separation column can also separate out the hydrogen chloride formed. In this case, it is advantageous to mount a drum to wash the gases from the stabilisation step to limit the discharge of acidic gases into the atmosphere.

As described above, the separation section can be disposed upstream (FIGS. 1B, 2.1B, 2.2B, 2.2D) or downstream (FIGS. 1A, 2.1A, 2.2A, 2.2C) of the hydroisomerisation section. In the first case, the major portion of the naphthenic and aromatic compounds avoid the hydroisomerisation section, with at least two important consequences:

a reduced volume for the hydroisomerisation section;

the aromatics present in the feed are not saturated, resulting in lower hydrogen consumption in the process and a lesser reduction in the octane number of the effluent.

In the second case (FIGS. 1A, 2.1A, 2.2A and 2.2C), the aromatic compounds and naphthenic compounds traverse the whole or at least a portion of the hydroisomerisation section. It may then be necessary to add, immediately upstream of the isomerisation section (if there is one) or the isomerisation section (if there is a plurality thereof), a reactor for saturating aromatic compounds. The criterion for adding a saturation reactor can, for example, be an aromatics content in the feed of more than 5% by weight.

As illustrated by FIGS. 2.1A, 2.1B; 2.2A; 2.2B; 2.2C and 2.2D, it is also possible to have at least two hydroisomerisation sections 2 and 3 with a recycle of a flux that is rich in linear paraffins to the head of section 2, and a flux that is rich in monobranched paraffins to the head of section 3. Such an arrangement allows the second section to be operated at a temperature that is lower than the first, which reduces cracking of the monobranched and multibranched paraffins formed in the first section, in particular cracking of tribranched paraffins such as 2,2,4-trimethylpentane which readily produces isobutane by acid cracking.

The following examples do not limit the scope of the invention.

EXAMPLES

Diffusional selectivity tests (Examples 1b and 2b) were carried out with a mixture of a feed from a hydroisomerisation reactor and containing normal hexane (nC6), 2-methylpentane (2MP) and 2,2-dimethylbutane (2,2DMB). The RON and MON of these compounds are shown in the table below:

| Paraffin | nC6 | 2MP | 2,2DMB |
|---|---|---|---|
| RON | 24.8 | 73.4 | 91.1 |
| MON | 26 | 74.2 | 93.4 |

Example 1

In Accordance with the Invention

The zeolitic adsorbents studied were EU-1 zeolites (one-dimensional structure with side pockets) and NU-87 (two-dimensional structure). These zeolites were in their $Na^+$ exchanged form, i. e., each of the as synthesised zeolites, once calcined, underwent successive ion exchange steps with a 1N NaCl solution, at ambient temperature. The EU-1 zeolite had a Si/B ratio of 24 and the NU-87 zeolite had a Si/Al ratio of 16.

a) Adsorption Capacity

The adsorption capacities of the EU-1 and NU-87 were measured gravimetrically at different temperatures (100° C. and 200° C.) at a partial pressure of 200 mbars of isopentane (iC5) using a TAG 24 symmetrical thermobalance from SETARAM. Before each adsorption measurement, the solids were regenerated for 4 hours at 380° C. The results are shown in Table 1 below:

TABLE 1 adsorption capacity of EU-1 and NU-87 zeolites

| Temperature | Mass of iC5 adsorbed (mg/g) with an iC5 partial pressure of 200 mbar | |
|---|---|---|
| (° C.) | EU-1 | NU-87 |
| 100 | 80.3 | 92.9 |
| 200 | 49.6 | 58.8 |

b) Diffusional Selectivity

The diffusional selectivities of normal hexane (nC6), 2-methylpentane (2MP) and 2,2-dimethylbutane (2,2DMB) were determined experimentally by reverse chromatography. To this end, the response of a fixed bed of zeolite to an "impulse" type concentration perturbation was measured. A 10 cm column filled with 1.4 g of zeolite, maintained at a constant temperature of 200° C., was traversed by a 1 nl/h flow of nitrogen. The pressure in the column was 1 bar and it were operated in the gas phase. The responses of the column to injection of different hydrocarbons was measured. The results obtained are shown in Table 2, in the form of a first moment ($\mu_1$) or average residence time and a second moment ($\mu_2^c$) or curve variance. The "moment" analysis (see p. 246 in the work by D. Ruthven, "Principles of adsorption and adsorption processes", John Wiley & Sons, New York, 1984) teaches that the global resistance to material transfer R can be calculated using the following equation:

25/15 in which L is the length of the bed and v is the interstitial velocity in the bed.

This resistance is also shown in Table 2.

TABLE 2

| Zeolite | Temperature (° C.) | Hydrocarbon | $\mu_1$ (min) | $\mu_2^c$ ($min^2$) | R (min) |
|---|---|---|---|---|---|
| EU-1 | 200 | nC6 | 54.3 | 2074.1 | 5.1 |
| | | 2 MP | 20.6 | 330.1 | 5.6 |
| | | 2,2 DMB | 0 | 0 | ∞ |
| NU-87 | 200 | nC6 | 59.3 | 1220.5 | 2.5 |
| | | 2 MP | 40.1 | 1068.3 | 4.8 |
| | | 2,2 DMB | 13.1 | 546.1 | 22.9 |

The ratio α between the global resistances of 2 MP and 2,2DMP and between the global resistances of 2MP and nC6 were calculated to evaluate the diffusional selectivity of zeolites EU-1 and NU-87 in separating these three hydrocarbons. The values of α were calculated at 200° C. for EU-1 and NU-87. These values are shown in Table 3.

TABLE 3

| Zeolite | Temperature (° C.) | α (2MP.2,2DMB) | α (2MP/nC6) |
|---|---|---|---|
| EU-1 | 200 | ∞ | 1.1 |
| NU-87 | 200 | 4.76 | 1.9 |

Example 2

Comparative

The tests described in Example 1 were repeated under the same operating conditions, using silicalite zeolite with a three-dimensional structure as the zeolitic adsorbent. The silicalite had structure type MFI and had only 10 MR channels. It was in its $Na^+$ form and had a Si/Al ratio of 250.

a) Adsorption Capacity

TABLE 4

| Temperature (° C.) | Mass of iC5 adsorbed (mg/g) with a partial pressure of iC5 of 200 mbar |
|---|---|
| 100 | 47.0 |
| 200 | 24.0 |

Comparing the results of Tables 1 and 4, it can be seen that the adsorption capacities of EU-1 and NU-87 are higher than the adsorption capacities of silicalite at the temperatures under consideration. The adsorption capacity for iC5 is about 1.9 times higher than that of silicalite for EU-1 and 2.2 times for NU-87.

b) Diffusional Selectivity

TABLE 5

| Zeolite | Temperature (° C.) | Hydrocarbon | $\mu_1$ (min) | $\mu_2^c$ ($min^2$) | R (min) |
|---|---|---|---|---|---|
| Silicalite | 200 | nC6 | 28.7 | 321.5 | 2.8 |
| | | 2 MP | 16.3 | 388.5 | 3.2 |
| | | 2.2 DMB | 7.5 | 183.0 | 13.3 |

TABLE 6

| Zeolite | Temperature (° C.) | α (2,2DMB/2MP) | α (2MP/nC6) |
|---|---|---|---|
| Silicalite | 200 | 4.17 | 1.2 |

Comparing the results shown in Tables 3 and 6, it can be seen that zeolites EU-1 and NU-87 have very advantageous diffusional selectivities for separating hydrocarbons with different degrees of branching. In particular, 2,2DMB does not penetrate at all into the pores of the EU-1 zeolite (Table 2) under the experimental conditions given above, and the selectivity of this zeolite for separating 2,2DMB and 2MP is thus infinite, much greater than that of silicalite. The NU-87 zeolite has a better selectivity for separating 2,2DMB and 2MP than silicalite at 200° C., and it also has better selectivity than silicalite for separating 2MP and nC6.

In conclusion, NU-87 and EU-1 zeolites have a better capacity for adsorption than silicalite and a diffusional selectivity that is generally better to guarantee a gain in productivity with respect to a multibranched paraffin separation section using silicalite, and thus the process of the invention, associating hydroisomerisation and separation by adsorption, has a better yield than another process also associating hydroisomerisation and separation by adsorption but with an adsorbent not having the same characteristics as those defined in the invention.

What is claimed is:

1. A process for producing a gasoline stock with a high octane number by hydroisomerizing a C5–C8 feed in at least one hydroisomerisation section (2), comprising at least one reactor, and performing separation in at least one adsorption separation section (4) comprising at least one separation unit, said adsorption separation section containing at least one zeolitic adsorbent with at least two types of channels, principal channels with an opening defined by a ring of 10 oxygen atoms, and secondary channels with an opening defined by a ring of at least 12 oxygen atoms, wherein said feed can only access said secondary channels via the principal channels, wherein said separation section (4) produces at least two fluxes, a first flux (8, 18) that is rich in dibranched and tribranched paraffins, optionally in naphthenes and aromatics, which is sent to a gasoline pool, and a second flux (7, 9) that is rich in linear and monobranched paraffins that is delivered to the inlet to the hydroisomerisation section (2), and wherein said zeolitic adsorbent comprises a zeolite with a NES or MWW structure, or an NU-85 or NU-86 zeolite; or said zeolitic adsorbent comprises a zeolite with a EUO, NES, or MWW structure, or an NU-85 or NU-86 zeolite, said zeolitic adsorbent being mixed with zeolite type LTA.

2. A process according to claim 1, wherein said adsorbent in the separation section contains silicon and at least one element T selected from aluminium, iron, gallium and boron, and wherein the Si/T mole ratio is at least 10.

3. A process according to claim 1, wherein said zeolitic adsorbent in the separation section is a zeolite with structure type NES.

4. A process according to claim 1, wherein said zeolitic adsorbent in the separation section is a zeolite with structure type MWW.

5. A process according to claim 1, wherein said zeolitic adsorbent in the separation section is a NU-85 zeolite.

6. A process according to claim 1, wherein said zeolitic adsorbent in the separation section is a NU-86 zeolite.

7. A process according to claim 1, wherein said zeolitic adsorbent comprises a zeolite with a EUO, NES, or MWW structure, or an NU-85 or NU-86 zeolite, said zeolitic adsorbent being mixed with zeolite type LTA.

8. A process according to claim 1, wherein at least one light fraction is separated by distillation upstream or downstream of the hydroisomerisation (2, 3) and/or separation (4, 5) sections.

9. A process according to claim 8, wherein the light fraction, or the isopentane and/or pentane and/or a mixture of the two, or hexane, act as an eluant for the adsorption separation section.

10. A process according to claim 1, wherein the feed contains a C5 cut and at least one deisopentaniser and/or at least one depentaniser is/are located upstream or downstream of the hydroisomerisation (2, 3) and/or separation (4, 5) sections.

11. A process according to claim 10, wherein the resultant isopentane is sent to the gasoline pool.

12. A process according to claim 1, wherein the feed contains a C6 cut but contains no C5 cut, and at least one deisohexaniser is disposed upstream or downstream of the hydroisomerisation (2, 3) and/or separation (4, 5) sections.

13. A process according to claim 1, butane and/or isobutane is used as an eluant for the adsorption separation section.

14. A process according to claim 1, wherein hydroisomerisation is carried out at temperatures in the range 25° C. to 450° C., at a pressure in the range 0.01 to 0.7 MPa, at a space velocity, measured in kg of feed per kg of catalyst per hour, in the range 0.5 to 2, and with a $H_2$/hydrocarbon mole ratio in the range 0.01 to 50.

15. A process according to claim 1, wherein separation is carried out at temperatures in the range 50° C. to 450° C. and at a pressure in the range 0.01 to 7 MPa.

16. A process according to claim 1, wherein said first flux consists essentially of dibranched and tribranched paraffins, and said second flux consists essentially of linear and monobranched.

17. A process for producing a gasoline stock with a high octane number by hydroisomerizing a C5–G8 feed in at least a first hydroisomerization section and a second hydroisomerization section, and performing separation in at least one adsorption separation section (4) comprising at least one separation unit, said adsorption separation section containing at least one zeolitic adsorbent with at least two types of channels, principal channels with an opening defined by a ring of 10 oxygen atoms and secondary channels with an opening defined by a ring of at least 12 oxygen atoms, wherein said feed can only access said secondary channels via the principal channels, wherein said separation section produces three fluxes, a first flux (8, 18, 28, 38) that is rich in dibranched and tribranched paraffins, optionally in naphthenes and aromatic compounds that is sent to a gasoline pool, a second flux (11, 16,20, 24, 30, 36) that is rich in linear paraffins that is delivered to the inlet to the first hydroisomerisation section and at third flux (12, 21, 26, 34, 35, 39) that is rich in monobranched paraffins that is delivered to the inlet to the second hydroisomerisation section (3), and wherein said zeolitic adsorbent comprises a zeolite with a NES or MWW structure, or an NU-85 or NU-86 zeolite; or said zeolitic adsorbent comprises a zeolite with a EUO, NES, or MWW structure, or an NU-85 or NU-86 zeolite, said zeolitic adsorbent being mixed with zeolite type LTA.

18. A process according to claim 17, wherein the whole of the effluent from the first hydroisomerisation (2) section traverses the second section (3).

19. A process according to claim 18, wherein the separation section (4) is located downstream of the hydroisomerisation sections (2, 3), the feed (1) is mixed with the recycle of paraffins (30) from the separation section (4), the resulting mixture (33) is sent to the first hydroisomerisation section (2), the effluent leaving the first hydroisomerisation section is mixed with the flux that is rich in monobranched paraffins (39) from the separation section (4), then the mixture is sent to the second hydroisomerisation section (3), and the effluent (37) from said latter section is sent to the separation section (4).

20. A process according to claim 18, wherein the separation section (4) is located upstream of hydroisomerisation sections (2, 3), the feed (1) is mixed with the flux (14) from the second hydroisomerisation section (3), then the resulting mixture (23) is sent to the separation section (4), the linear paraffin-rich effluent (11) is sent to the first hydroisomerisation section (2), the monobranched paraffin-rich flux (12) from the section (4) for separating an effluent (13) from the first hydroisomerisation section (2) is added, and the ensemble is sent to the second hydroisomerisation section (3).

21. A process according to claim 17, wherein the effluents from the hydroisomerisation sections are sent to at least one separation section.

22. A process according to claim 17, wherein said adsorbent in the separation section contains silicon and at least one element T selected from aluminium, iron, gallium and boron, and wherein the Si/T mole ratio is at least 10.

23. A process according to claim 17, wherein said zeolitic adsorbent in the separation section is a zeolite with structure type NES.

24. A process according to claim 17, wherein said zeolitic adsorbent in the separation section is a zeolite with structure type MWW.

25. A process according to claim 17, wherein said zeolitic adsorbent in the separation section is a NU-85 zeolite.

26. A process according to claim 17, wherein said zeolitic adsorbent in the separation section is a NU-86 zeolite.

27. A process according to claim 17, wherein said zeolitic adsorbent comprises a zeolite with a EUO, NES, or MWW structure, or an NU-85 or NU-86 zeolite, said zeolitic adsorbent being mixed with zeolite type LTA.

28. A process according to claim 17, wherein at least one light fraction is separated by distillation upstream or downstream of the hydroisomerisation and/or separation sections.

29. A process according to claim 28, wherein the light fraction, or the isopentane and/or pentane and/or a mixture of the two, or hexane, act as an eluant for the adsorption separation section.

30. A process according to claim 17, wherein the feed contains a C5 cut and at least one deisopentaniser and/or at least one depentaniser is/are located upstream or downstream of the hydroisomerisation and/or separation sections.

31. A process according to claim 30, wherein the resultant isopentane is sent to the gasoline pool.

32. A process according to claim 17, wherein the feed contains a C6 cut but contains no C5 cut, and at least one deisohexaniser is disposed upstream or downstream of the hydroisomerisation and/or separation sections.

33. A process according to claim 17, butane and/or isobutane is used as an eluant for the adsorption separation section.

34. A process according to claim 17, wherein hydroisomerisation is carried out at temperatures in the range 25° C. to 450° C., at a pressure in the range 0.01 to 0.7 MPa, at a space velocity, measured in kg of feed per kg of catalyst per hour, in the range 0.5 to 2, and with a $H_2$/hydrocarbon mole ratio in the range 0.01 to 50.

35. A process according to claim 17, wherein separation is carried out at temperatures in the range 50° C. to 450° C. and at a pressure in the range 0.01 to 7 MPa.

36. A process according to claim 17, wherein said first flux consists essentially of dibranched and tribranched paraffins, said second flux consists essentially of linear paraffins and said third flux consists essentially of monobranched paraffins.

37. A process for producing a gasoline stock with a high octane number by hydroisomerizing a C5–C8 feed in at least one hydroisomerisation section (2) comprising at least one reactor, and performing separation in at least one adsorption separation section (4) comprising at least one separation unit, said adsorption separation section containing at least one zeolitic adsorbent with at least two types of channels, principal channels with an opening defined by a ring of 10 oxygen atoms and secondary channels with an opening defined by a ring of at least 12 oxygen atom, wherein said feed can only access said secondary channels via the principal channels, wherein said zeolitic adsorbent comprises a zeolite with a NES or MWW structure, or an NU-85 or NU-86 zeolite.

38. A process for producing a gasoline stock with a high octane number by hydroisomerizing a C5–C8 feed in at least one hydroisomerisation section (2) comprising at least one reactor, and performing separation in at least one adsorption separation section (4) comprising at least one separation unit, said adsorption separation section containing at least one zeolitic adsorbent with at least two types of channels, principal channels with an opening defined by a ring of 10 oxygen atoms and secondary channels with an opening defined by a ring of at least 12 oxygen atom, wherein said feed can only access said secondary channels via the principal channels, wherein said zeolitic adsorbent comprises a zeolite with a EUO, NES, or MWW structure, or an NU-85 or NU-86 zeolite, said zeolitic adsorbent being mixed with zeolite type LTA.

* * * * *